US009867475B2

(12) United States Patent
Kulju et al.

(10) Patent No.: US 9,867,475 B2
(45) Date of Patent: Jan. 16, 2018

(54) MATTRESS STRUCTURE, MATTRESS SYSTEM AND METHOD FOR USING A MATTRESS

(75) Inventors: Petri Kulju, Sastamala (FI); Henry Sukari, Lempaala (FI)

(73) Assignee: MASKUN KALUSTETALO OY, Masku (FI)

( * ) Notice: Subject to any disclaimer, the term of this patent is extended or adjusted under 35 U.S.C. 154(b) by 929 days.

(21) Appl. No.: 13/820,103

(22) PCT Filed: Sep. 1, 2011

(86) PCT No.: PCT/FI2011/000039

§ 371 (c)(1),
(2), (4) Date: May 20, 2013

(87) PCT Pub. No.: WO2012/028763

PCT Pub. Date: Mar. 8, 2012

(65) Prior Publication Data

US 2015/0305514 A1 Oct. 29, 2015

(30) Foreign Application Priority Data

Sep. 1, 2010 (FI) ..... 20100304

(51) Int. Cl.

| | |
|---|---|
| ***A47C 27/00*** | (2006.01) |
| ***A47C 27/05*** | (2006.01) |
| ***A47C 27/06*** | (2006.01) |
| ***A47C 27/14*** | (2006.01) |
| ***A47C 27/15*** | (2006.01) |

(52) U.S. Cl.

CPC ..... *A47C 27/001* (2013.01); *A47C 27/05* (2013.01); *A47C 27/148* (2013.01); *A47C 27/15* (2013.01); *A47C 27/062* (2013.01)

(58) Field of Classification Search

CPC ..... A47C 27/00; A47C 27/001; A47C 27/04; A47C 27/05; A47C 27/053; A47C 27/056; A47C 27/06; A47C 27/061; A47C 27/062; A47C 27/063; A47C 27/064; A47C 27/14; A47C 27/148; A47C 27/15

USPC ... 5/727, 728, 716, 717, 720, 722, 723, 740, 5/655.8, 655.9, 953

See application file for complete search history.

(56) References Cited

U.S. PATENT DOCUMENTS

| | | | | | |
|---|---|---|---|---|---|
| 2,629,111 | A * | 2/1953 | Korney | A47C 27/0453 | 5/716 |
| 2,651,788 | A * | 9/1953 | Forwood | A47C 27/001 | 5/1 |
| 3,210,781 | A * | 10/1965 | Pollock | A47C 27/001 | 267/91 |
| 3,419,920 | A * | 1/1969 | Maddux, Jr. et al. | A47C 27/146 | 5/411 |
| 3,521,311 | A * | 7/1970 | Cohen | A47C 27/144 | 5/727 |
| 3,534,417 | A * | 10/1970 | Boyles | A47C 27/148 | 5/727 |

(Continued)

*Primary Examiner* — Robert G Santos
(74) *Attorney, Agent, or Firm* — Kubovcik & Kubovcik

(57) ABSTRACT

A mattress (10) being asymmetric such that in the same surface (31, 32) of the mattress there are at least two zones (22, 25) or areas of different hardnesses for the different parts (41-44) of the user's (40) body, located such that the first zone (22) or area between the midpoint of the mattress and one end (30*a*) is softer than the second zone (25) or area between the midpoint of the mattress and the other end (30*b*). The mattress system has three mattresses (10-10*c*) of different hardnesses, the zones (21-26) or areas in one side of the mattresses being softer than the corresponding zones or areas in the other side of the mattress.

4 Claims, 9 Drawing Sheets

(56) References Cited

U.S. PATENT DOCUMENTS 3,846,857 A * 11/1974 Weinstock ..... A47C 27/15 5/722
3,939,508 A * 2/1976 Hall ..... A47C 27/15 297/DIG. 1
4,004,305 A * 1/1977 Rubin ..... A47C 27/001 5/13
4,213,214 A * 7/1980 Gilhooly ..... A47C 27/001 5/679
4,679,266 A * 7/1987 Kraft ..... A47C 27/00 5/716
5,101,527 A * 4/1992 Wadsworth ..... A47C 27/144 5/496
5,579,549 A * 12/1996 Selman ..... A47C 27/05 427/288
5,740,574 A * 4/1998 Piraino ..... A47C 27/062 5/716
5,868,383 A * 2/1999 Codos ..... B68G 9/00 267/166.1
5,960,496 A * 10/1999 Boyd ..... A47C 27/144 5/722
5,987,678 A * 11/1999 Ayers ..... A47C 23/0433 5/655.8
6,202,239 B1 * 3/2001 Ward ..... A47C 27/082 5/713
6,256,821 B1 * 7/2001 Boyd ..... A47C 27/144 5/722
7,191,483 B2 * 3/2007 Hochschild ..... A47C 27/001 5/691
7,386,903 B2 * 6/2008 Hochschild ..... A47C 27/001 5/691
7,748,066 B2 * 7/2010 Gladney ..... A47C 27/061 5/710
7,992,242 B2 * 8/2011 Antinori ..... A47C 23/0522 5/717
9,060,617 B2 * 6/2015 James ..... A47C 27/04
2005/0066446 A1 * 3/2005 Gladney ..... A47C 27/061 5/690
2006/0272098 A1 * 12/2006 Hochschild ..... A47C 27/001 5/727
2007/0017033 A1 * 1/2007 Antinori ..... A47C 23/0522 5/716
2007/0022540 A1 * 2/2007 Hochschild ..... A47C 27/001 5/727
2008/0072382 A1 * 3/2008 James ..... A47C 27/04 5/717
2015/0305514 A1 * 10/2015 Kulju ..... A47C 27/05 5/727
2017/0224126 A1 * 8/2017 O'Connell, Jr. ..... A47C 27/148

* cited by examiner

MATTRESS STRUCTURE, MATTRESS SYSTEM AND METHOD FOR USING A MATTRESS

OBJECT OF THE INVENTION

The object of the invention is a mattress with at least two zones or areas with differing hardnesses for different parts of the user's body.

PRIOR ART

The purpose of a mattress is to cushion a bed such that it is moulded according to the human body and provides continuous support for the entire body. Various mattresses with highly differing structures are currently in use, including innerspring mattresses, foam mattresses, natural latex mattresses and water- or air-filled mattresses. Combinations of these can also be produced. For instance, an innerspring mattress has a cushion layer made of, for example, plastic foam of a required thickness and hardness on metal springs on both sides of the mattress. Different types of mattresses are used as a separate mattress or as a box-spring mattress integrated with the bed frame, as a so-called American-style bed or as a motorised bed.

It is known that the weight of a human body distributes unevenly over the surface of a mattress. Thus the hip area, for example, tends to settle more than other parts. The known solution for this is to provide the mattress with zones of varying hardness. Making the mattress harder in the middle, in other words at the hip area, prevents excessive settling of the hips. At the same time, the hardness of the mattress can be selected to suit the user's weight and preferences. The different zones can be permanently incorporated in the mattress or they can be separate parts joined and added to the mattress as required. Such solutions are presented in the publications U.S. Pat. No. 3,846,857 A, WO 9208398 A, US 2008201856 A1 and EP 2047772 A1.

A drawback of known mattresses is, however, that even if the mattress at the time of purchase is selected according to the user's weight as described above, the mattress may not be suitable anymore if the user's weight or body structure changes. If, for example, the user gains weight, his/her hips will settle more in the middle of the mattress. The settling may even be to such an extent that it is impossible to find the right sleeping posture on the mattress, which will result in other problems, such as back pain.

Said publications of prior art aim to solve this problem by assembling the mattress from separate pieces as required by the specific user. This may be possible in hospitals and similar institutions, but for use at home modifying the mattress this way is neither sensible nor possible. A mattress purchased for use at home must be easy to use, without any structural modifications required from the user. This, however, makes modifications to the mattress or the method for using it impossible by known solutions.

PURPOSE OF THE INVENTION

The purpose of this invention is to create a new mattress structure free of the above-mentioned problems. An additional purpose of the invention is to create a mattress for multiple purposes, suitable for different users, and one which remains suitable for the user even if his/her weight or body type changes. Furthermore, the purpose of the invention is to create a new mattress system and a method for using a mattress.

CHARACTERISTICS OF THE INVENTION

A mattress according to the invention is characterized in that the mattress is asymmetric such that there are at least two zones or areas of different hardnesses in the same surface of the mattress, located such that the first zone or area between the midpoint of the mattress and one end is softer than the second zone or area between the midpoint of the mattress and the other end.

Thus the user of the mattress can choose a softer or a harder area for his/her shoulder area and upper back either by changing his/her position such that his/her head is placed at the other end of the bed and the mattress, or by rotating the mattress horizontally such that he/she can sleep in the bed with his/her head faced in the same direction as before.

EMBODIMENTS OF THE INVENTION

An advantageous embodiment of the mattress according to the invention is characterized in that between the zones or areas of different hardnesses located in the same surface of the mattress, on both sides of the midpoint, there is a zone or area harder than said zones or areas.

This area in the middle of the mattress is for the user's hips, which exert the greatest load on the mattress. A mattress according to the invention is intended to be used such that the user's shoulders and upper back lay on an asymmetric zone or area of greater hardness. If the user gains weight over time and the mattress settles more than intended in the middle, the user will rotate the mattress around horizontally on the bed. Thus the user's shoulders and upper back lay on a softer asymmetric zone or area, as a result of which the user's shoulders and upper back settle more than previously.

It is essential that this way the user of the mattress can match the settling of his/her shoulders and upper back according to the settling of the hips, whereby the user's spine will remain as straight as possible during sleeping. On a mattress according to the invention, the user's feet are thus, depending on the orientation of the mattress, either on the hard area or soft area on either end of the mattress. This is not significant, however, as the hips and the shoulders must settle on the mattress in an appropriately similar manner.

Another advantageous embodiment of the mattress according to the invention is characterized in that, in addition to the zones or areas of different hardnesses located in the same surface of the mattress, there are hard edge zones or areas in both ends of the mattress. The hard edges support the structure of the mattress such that a person can sit on its edge.

A third advantageous embodiment of the mattress according to the invention is characterized in that

- there are surface layers of different hardnesses in opposite surfaces of the mattress such that the said asymmetric zones or areas of different hardnesses are formed in both sides of the mattress, and
- the zones or areas in one side of the mattress are softer than the corresponding zones or areas in the other side of the mattress.

This way two zones or areas of different hardnesses are created in both sides of the mattress for the user's shoulders and upper back. With different hardnesses in both sides of the mattress, this amounts to four zones or areas of different hardnesses in the same mattress for the user's shoulders and upper back. Thus the user can select the required characteristics of the mattress by turning the mattress over.

As people generally tend to gain weight as they age, it is recommendable for the user of the mattress to select a new mattress according to his/her size and weight such that, in the softer side of the mattress, the hardness of the midpart of the mattress matches the load exerted by the hips. The mattress is subsequently used such that the user's shoulders lie on the harder zone or area in the softer side of the mattress. As the user gains weight, the increased settling exerted by the hips can be compensated by rotating the mattress horizontally, whereby the user's shoulders lie on the softer zone or area in the softer side of the mattress. Thus the user's shoulders will also settle more, corresponding with the increased settling of the hips.

If the user gains even more weight, the procedure described above may not be sufficient. In that case the mattress is turned over such that the harder side of the mattress faces up and the user's shoulders are matched with the harder zone or area in the harder side of the mattress. If the user's weight increases further, the characteristics of the same mattress can be changed once more by additionally rotating the mattress horizontally, whereby the user's shoulders are placed on the softer zone or area in the harder side of the mattress. Thus the user's shoulders will again settle more, corresponding with the increased settling of the hips in the middle of the mattress. If one wishes to further modify the characteristics of the mattress and all the said four stages of modifying the characteristics of a mattress according to the invention have been carried out, the mattress or the mattress component of the bed structure, i.e. the mattress set, must be replaced. The upholstery of the structure may include a zipper, for example, which can be opened in order to replace the mattress set.

Mattress System

Another object of the invention is a mattress system comprising at least two different mattresses.

Characteristics of the Mattress System

A mattress system according to the invention is characterized in that

- the mattress system comprises at least two different mattresses with differing hardnesses in their opposing sides,
- the hardness characteristics of the different sides of the mattresses form a series wherein the softest area is the softer side of the first mattress, after which the following areas are each harder than the preceding one: the harder side of the first mattress, the softer side of the second mattress and the harder side of the second mattress.

Embodiments of the Mattress System

An advantageous embodiment of the mattress system according to the invention is characterized in that the mattress system comprises three different mattresses, wherein the hardnesses of the different sides are marked as follows, from the softest to the hardest:

XS=the first side of the 1st mattress,
S=the second side of the 1st mattress,
M=the first side of the 2nd mattress,
L=the second side of the 2nd mattress,
XL=the first side of the 3rd mattress, and
XXL=the first side of the 3rd mattress.

Another advantageous embodiment of the mattress system according to the invention is characterized in that both sides of each of the three mattresses are asymmetric such that there are at least two zones or areas of different hardnesses in the same surface of the mattress, located such that the first zone or area between the midpoint of the mattress and one end is softer than the second zone or area between the midpoint of the mattress and the other end.

Each three mattresses of the mattress system according to the invention can be used in four different ways, as presented in the characteristics of mattresses according to the invention above. Thus a mattress system according to the invention comprises a total of 12 different methods for using the mattress. By means of the system, one first selects the accurately suitable mattress solution and subsequently the advantageous method for using the mattress. Even after the mattress is selected one can, as required, easily switch to another mattress of the system, for example by replacing the mattress set or a part of it. With the system, defining the mattress required by the user and its subsequent modification needs is substantially easier and more accurate than by known methods.

Another object of the invention is a novel method for using a mattress. A method for using a mattress according to the invention is characterized in that

- a mattress suitable for the person using the mattress is selected from a mattress system wherein the mattresses are marked similarly to the size markings used by the clothing industry, e.g. XS, S, M, L, XL and XXL, which substantially match the size of clothing used by the person, and
- the hardness of the mattress surface corresponds with the size markings, e.g. XS, S, M, L, XL and XXL, such that the marking corresponding to the size of the person using the mattress is matched with the mattress hardness suitable for the person.

An advantageous embodiment of the method for using a mattress according to the invention is characterized in that

- the person using the mattress first selects the suitable mattress on the basis of its size marking, e.g. XS, S, M, L, XL and XXL, and
- the person using the mattress subsequently selects the method for using the mattress by selecting either a softer (−) or a harder (+) mattress end for his/her head and shoulders.

Another advantageous embodiment of the method for using a mattress according to the invention is characterized in that, in the case of changes in the shape of the body of the person using the mattress, the person selects a new method for using the mattress by switching his/her position so that his/her head and shoulders rest on the other end of the mattress.

A third advantageous embodiment of the method for using a mattress according to the invention is characterized in that

- the person selects the preferred one from two sides of the mattress, both of which are marked by size, e.g. XS, S, M, L, XL and XXL, and
- in the case of changes in the size or weight of the body of the person using the mattress, the person turns the mattress over and selects the harder or the softer mattress on the opposite side.

EXAMPLES OF EMBODIMENTS

In the following, the invention is described using examples with reference to the appended drawings, in which

LIST OF FIGURES

FIGS. 1A to 1C show schematic views of vertically oriented sections across the length of a mattress according to the invention.

FIG. 2 shows a schematic side view of a mattress according to the invention and a person resting on the mattress.

FIG. 3 corresponds to FIG. 2 and shows a schematic side view of a mattress according to the invention and a person resting on the mattress in another position.

FIG. 4 shows a schematic view of three different mattresses in a mattress system according to the invention.

FIG. 5 shows a perspective view of a mattress according to the invention.

FIG. 6A to 6D show perspective views of different embodiments of the mattress according to the invention.

FIG. 7 corresponds to FIG. 1 and shows a schematic view of vertically oriented sections across the length of another mattress according to the invention.

FIG. 8 shows a schematic view of another mattress system according to the invention.

FIG. 9 shows a schematic view of a third mattress system according to the invention.

FIG. 10 shows a schematic view of a fourth mattress system according to the invention.

FIG. 11 shows a schematic view of a fifth mattress system according to the invention.

FIG. 12 shows a perspective view of yet another mattress according to the invention.

FIGS. 13A to 13B show a schematic side view and a partly sectional view of a mattress according to the invention and a bottom mattress to be joined therewith.

FIGS. 14A to 14B correspond to FIGS. 13A to 13*b* and show the bottom mattress in another position.

DESCRIPTION OF THE FIGURES

FIG. 1B shows an asymmetric mattress 10 according to the invention wherein the parts 22 (S) and 25 (M) on opposing sides of the hard part 24 (L) in the middle differ from each other. As both surface layers 31 and 32 of the mattress 10 also differ in hardness, a mattress solution for multiple uses according to the invention is created.

In FIG. 1C, the details of the solution according to the invention have been developed further. Here there are harder (L) zones 21 and 26 in both ends of the mattress 10, and between the soft (S) and hard (L) zone 22 and 24 there is a medium hard (M) zone 23. Both surface layers 31 and 32 of the mattress 10 also differ in hardness. Thus there are several zones 21, 22, 23, 24, 25 and 26 between the ends 30*a* and 30*b* of the mattress 10 of FIG. 10 with different hardnesses such that also the hardness of the mattress 10 varies according to said zones 21 to 26. The zones 21 to 26 of the mattress 10 can be rectangular areas extending from one edge of the mattress 10 to the other, but they can also be areas of the mattress 10 with different shapes, whereon the user of the mattress 10 rests.

Figure 1A:
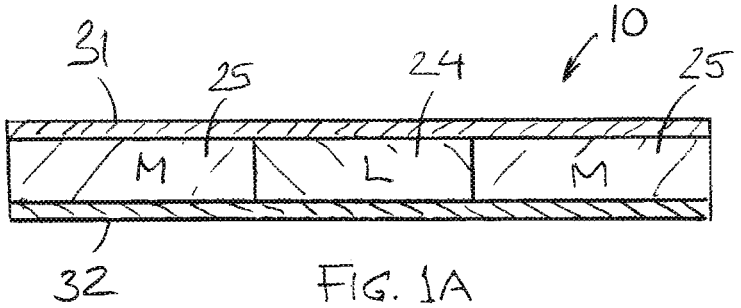
FIGS. 1A to 1C show schematic views of vertically oriented sections across the length of a mattress 10 according to the invention. The mattress 10 in FIG. 1A has a hard part 24 (L) in the middle for the hips and softer parts 25 (M) at the edges for the shoulders of the person sleeping. According to the known approach, when the softer part M under the shoulders slackens, the sleeping person can switch his/her sleeping position so that his/her head is located at the other end of the mattress. This arrangement will not work, however, because often at that point the midpart L has also slackened. The mattress 10 in FIG. 1A can also have surface layers 31 and 32 of differing hardnesses for persons of different weight, but this arrangement will not work well because both ends have equally soft parts 25 (M).
Figure 1B:
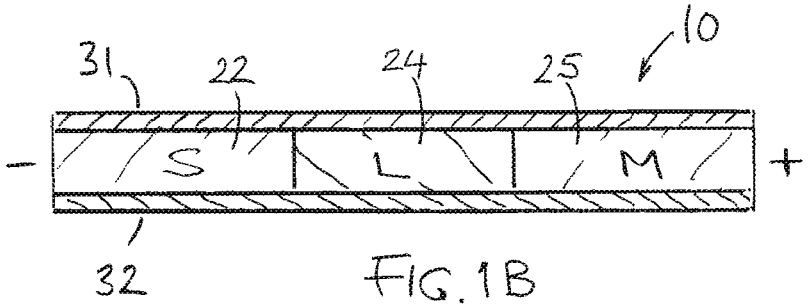
Figure 1C:
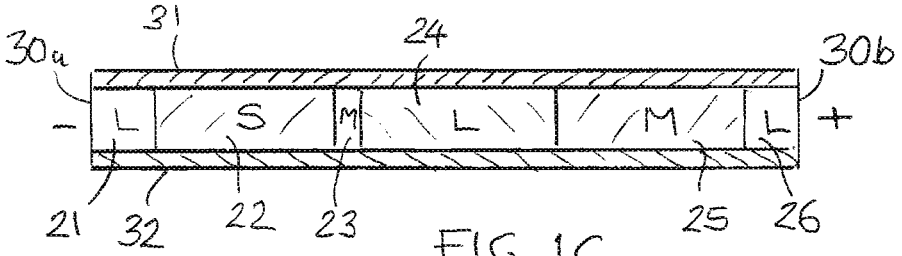

The mid zone 24 in the mattress 10 of FIG. 1C is a hard (L) zone because it is located at the hips of the user of the mattress 10 and carries a major proportion of the user's weight. The narrow zones 21 and 26 in the ends 30*a* and 30*b* of the mattress 10 are also hard (L) so as to make the mattress 10 sufficiently rigid for sitting on the edge of the bed, for example. If required, corresponding hard edge zones can be located also in the side edges of the mattress 10, which are not shown in FIG. 1.

Figure 10:
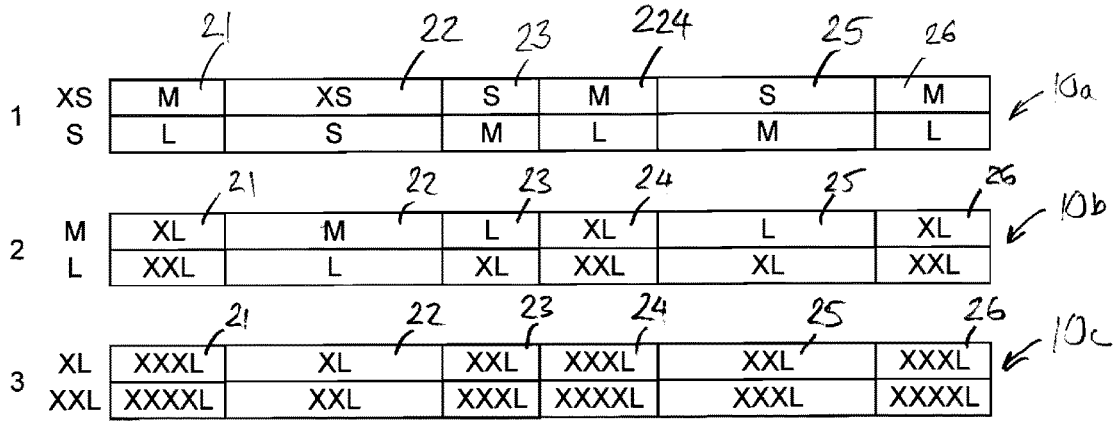

The larger zones 22 and 25 close to the ends 30*a* and 30*b* of the mattress 10 in FIG. 10 are softer than the hard zone 24 in the middle. According to the invention, the structure of the mattress 10 is asymmetric such that the zone 25 close to the end 30*b* to the right in FIG. 10 is of medium hardness (M) whereas the zone 25 close to the end 30*a* to the left in FIG. 1 is soft (S). There is a narrow zone 23 of medium hardness (M) between the soft (S) zone 22 and the hard (L) zone 24 in order to prevent the body of the user of the mattress 10 from feeling a threshold that could be caused by an excessive hardness gradient. The surface layers 31 and 32 in the mattress 10 of FIG. 1 are of different hardnesses whereby the required general hardness is achieved by turning the mattress 10 over.

Figure 2:
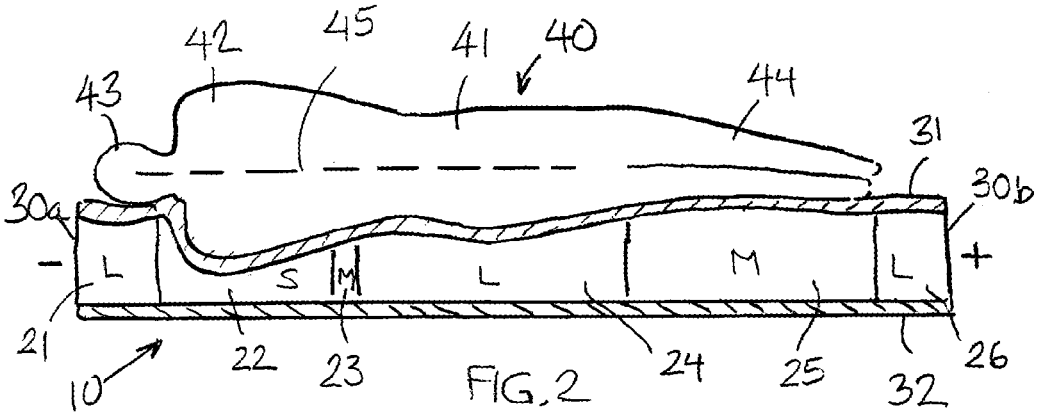

FIG. 2 shows a schematic side view of the mattress 10 according to the invention and a person 40 resting on the mattress, i.e. the user of the mattress 10. The mattress 10 in FIG. 2 has zones corresponding to FIG. 10. The hardnesses of the zones are marked therein as follows: zone 21 is hard (L), zone 22 is soft (S), zone 23 is medium hard (M), zone 24 is hard (L), zone 25 is medium hard (M) and zone 26 is hard (L). The person 40 in FIG. 2 is broad-shouldered, and thus his/her shoulders rest on the soft (S) part 22 of the mattress, and the hips 41 rest on the hard (L) part 24. This way the person's 40 spine 45 is substantially straight as he/she sleeps.

Figure 3:
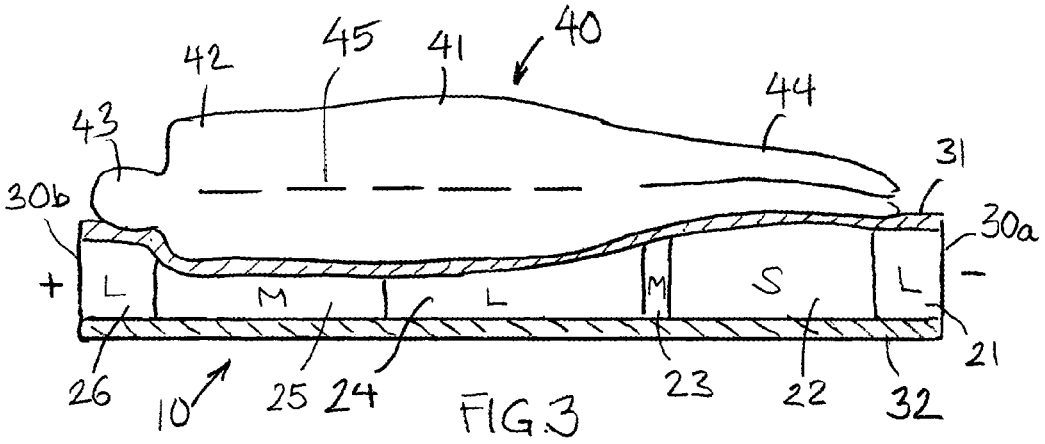

FIG. 3 shows a situation that may occur later on, as the conditions change. The user 40 in the example of FIG. 3 has gained weight. Thus it is advantageous for him/her to turn around on the mattress 10 such that the shoulders 42 are located on the other, i.e. harder end of the mattress, on the medium hard (M) area 25, whereby the user's 40 spine 45 will remain sufficiently straight even in these changed conditions. In FIG. 3, the harder end is marked with (+) and the other softer end with (−). Both surface layers 31 and 32 of the mattress 10 also differ in hardness, whereby the person can switch the sides 31 or 32 of the mattress 10 and/or the end (+) or (−) of the mattress as required.

Figure 4:
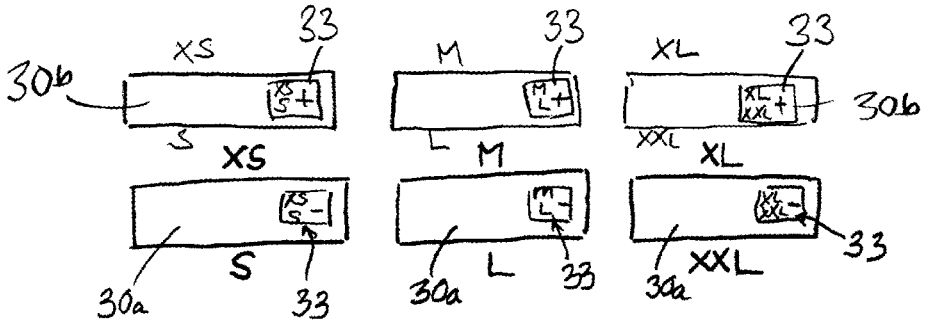

FIG. 4 shows a schematic view of a mattress system according to the invention comprising three different mattresses 10*a*, 10*b* and 10*c*. The hardnesses of all the surfaces in the mattresses 10*a* to 10*c* differ from each other and are marked with the letters XS, S, M, L, XL and XXL, of which XS is the softest and XXL the hardest. There is also a marking (+) or (−) on the ends 30*a* of the mattresses 10*a* to 10*c* indicating the hardnesses of the various surfaces of each mattress and if the mattress end in question is softer or harder. According to the invention, the weight of the person 40 using the mattress 10 is specified to correspond with the letters indicating the size of the person as shown in Table 1:

TABLE 1

| 1 | 2 | 3 | 4 | 5 | 6 |
|---|---|---|---|---|---|
| XS | S | M | L | XL | XXL |
| — | Soft | Medium | Hard | Extra hard | — |
| 40 to 55 kg | 55 to 70 kg | 70 to 85 kg | 85 to 105 kg | 105 to 125 kg | 125 to 150 kg |

This way the mattress most suitable for the person can be determined by means of the letters indicating the person's size.

Figure 5:
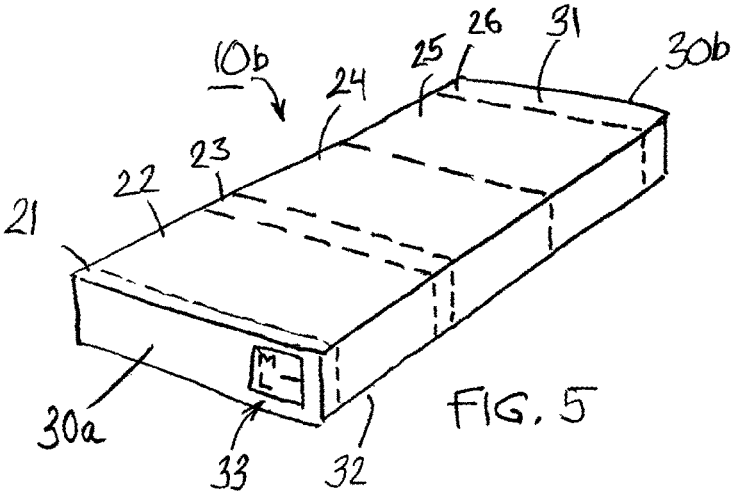

FIG. 5 shows a perspective view of the middle mattress 10*b* in the mattress system of FIG. 4, with a marking 33 on its end 30*a*. The marking 33 indicates that this is a mattress 10 where the different sides correspond to the hardnesses medium (M) and hard (L). The marking 33 further includes a sign (–) indicating that the softer end of the mattress 10 is on the side of the end 30*a*. The softer end is dictated by the softer (S) zone 22 located in this end. Similarly the opposite end 30*b* of the mattress 10*b* also has a marking with the same hardness marks (M) and (L) and (+), which means that this is the medium (M) hard zone 25 of the mattress 10, i.e. the harder end of the mattress 10.

Figure 6A:
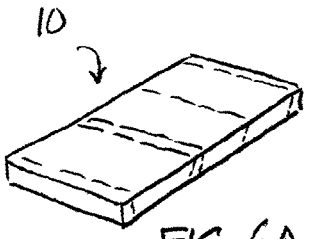
Figure 6B:
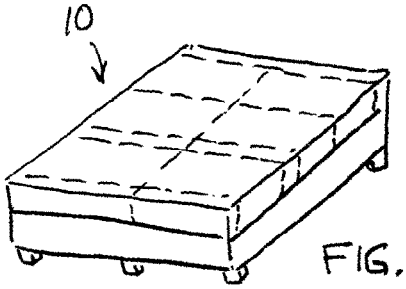
Figure 6C:
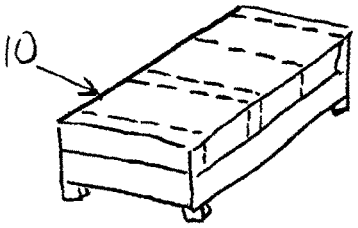
Figure 6D:
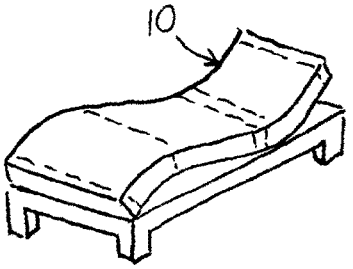

FIGS. 6A to 6D show perspective views of different embodiments of the mattress according to the invention. FIG. 6*a* shows a mattress 10 only, such as an innerspring mattress. FIG. 6B shows a so-called American style bed, FIG. 6C a box-spring mattress and FIG. 6D a motorised bed, all these including an innerspring mattress 10 as their component.

Figure 7:
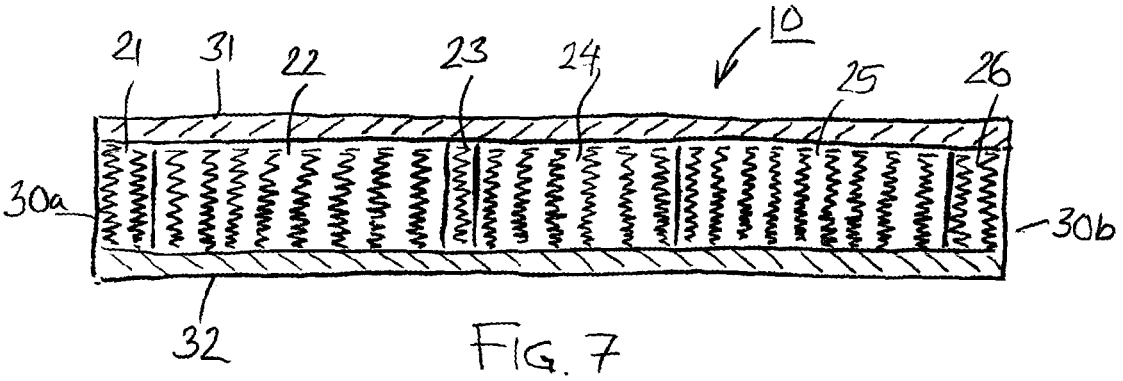

FIG. 7 shows in greater detail a vertically oriented sectional view across the length of a mattress 10 according to the invention. FIG. 7 has zones 21 to 26 of the mattress 10 marked on it, corresponding to the zones in the mattress 10 of FIG. 1. In the embodiment of FIG. 1, elastic elements were not shown in greater detail because they can vary in known manner. The zones of different hardnesses can thus be formed from many different materials, such as plastic foam or rubber. In the embodiment of FIG. 7, the elastic elements are vertical coil springs, which can be installed in several ways, separately or encased. There may be partition walls between coil springs, or the partition walls may be omitted. The partition walls shown in FIG. 7 only schematically describe borders between different zones. The surface layers in the mattress of FIG. 7 are made of plastic foam, for example, and by means of these the opposite sides of the mattress are arranged to have different hardnesses.

Figure 8:
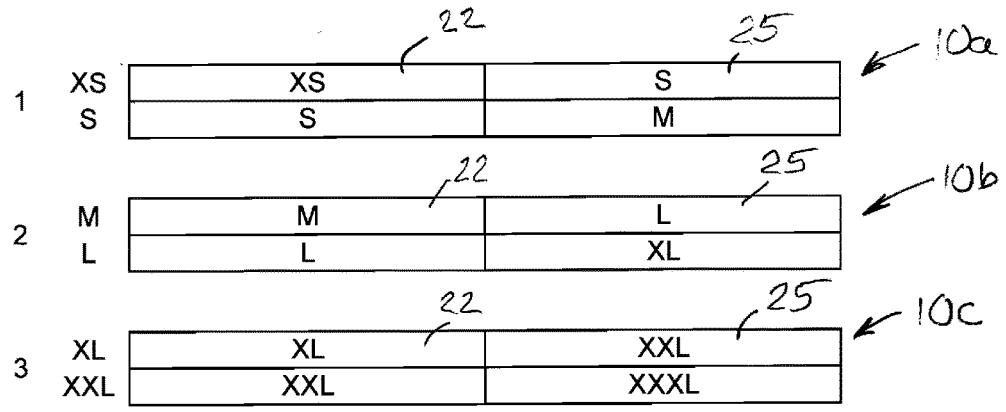

FIG. 8 shows a schematic view of a mattress system according to the invention in its most simple form. The system comprises three mattresses 1, 2 and 3 shown by reference numbers 10*a*, 10*b* and 10*c* in FIG. 8. The different sides of these mattresses are indicated by the size markings XS, S, M, L, XL and XXL known in the clothing industry, aiming to make the selection of a suitable mattress as simple as the selection of a shirt or another clothing item according to the person's size. The smallest of the size markings in the clothing industry referred to above is XS and the largest XXL. According to the invention, it has been observed that one can very accurately determine the preferred hardness or elasticity of a mattress used by a person on the basis of his/her size. Thus XS in a mattress means that it is intended for a small person with a low weight who requires a sufficiently soft and elastic mattress. Correspondingly, XXL in a mattress means that it is intended for a large and heavy person who requires a sufficiently hard or rigid mattress.

The mattress system shown in FIG. 8 presents three mattresses 10*a*, 10*b* and 10*c*, each having different hardnesses in its different sides. Thus the mattress 10*a* has the markings XS and S on its opposite sides, describing the size of the intended user and at the same time the general degree of softness of these sides. Correspondingly, the mattress 10*b* has M and L on its opposite sides and the mattress 10*c* has XL and XXL on its opposite sides.

FIG. 8 also shows that one part in each mattress 10*a*, 10*b* and 10*c* has the same corresponding hardness marking as the whole side of the mattress. For example, one area 22 on the upper side XS in the mattress 10*a* of FIG. 8 is also marked by XS. This area 22 of the mattress is the softer part in the side XS of the mattress 10*a*. Correspondingly, the area 25 of the mattress marked with S is the harder part in the side XS of the mattress 10*a*. The purpose of the shown marking is to emphasise that it is the softer part of the mattress that usually is decisive in the choice. If, for example, the small person, who is probably also light in weight, choosing the mattress 10*a* is also broad-shouldered, he/she will lie on the side XS of the mattress 10*a* such that his/her shoulders are located on the softer area XS of the mattress. Thus his/her hips are located on the harder area 25 of the same mattress, indicated by the marking S in FIG. 8. If the body structure of a small person selecting the mattress 10*a* includes a broad and heavy hip area, he/she will lie on the side XS of the mattress 10*a* such that his/her hips are located on the softer area XS of the mattress. The head and shoulders thus lie on the harder area 25 of the mattress.

It is advantageous in the mattress system of FIG. 8 that the opposite sides of each mattress 10*a*, 10*b* and 10*c* include two different sections of the mattress. This is of great importance for the multifunctionality of the mattress and its method of use. For example, when a person chooses the mattress 10*a* he/she is likely to start using the side XS such that his/her head and shoulders are either on the area XS or S. If the shape or structure of the person's body or his/her weight later on changes, he/she can turn the mattress 10*a* over whereby the side S of the mattress becomes available for him/her. Again in this case he/she can choose whether to place his/her head and shoulders on the softer area S or on the harder area M of the harder side S of the mattress 10*a*. All the same options and choices are naturally also available for the other mattresses 10*b* and 10*c* in the system that are intended for larger persons.

In the mattress system of FIG. 8, the hardnesses of the different areas in the different sides XS, S, M, L, XL and XXL of all the mattresses 10*a*, 10*b* and 10*c* can be determined differently depending on the material to be used and its elasticity. One example, wherein plastic foam is used, is presented in the Table 2 below which gives the unit weight in kg/m3 indicating the material hardness in different areas.

TABLE 2

| Mattress | Side | Softer end | Harder end |
|---|---|---|---|
| 1 | XS | 20 | 30 |
| | S | 30 | 40 |
| 2 | M | 40 | 50 |
| | L | 50 | 60 |
| 3 | XL | 60 | 70 |
| | XXL | 70 | 80 |

Figure 9:
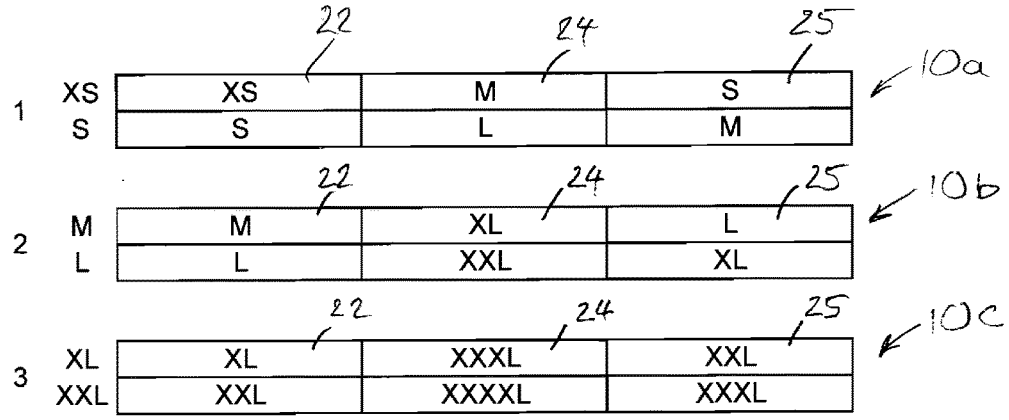

FIG. 9 shows a schematic view of a third mattress system according to the invention wherein each mattress 10*a*, 10*b* and 10*c* has, in addition to a softer area 22 and a harder area 25, also an even harder mid area 24 between them. This embodiment better corresponds with the reality than the simplified embodiment shown in FIG. 8 because the hips usually require a stable area in the middle of the mattress. Otherwise the mattress system shown in FIG. 9 and its use correspond with what is said above.

The following Table 3 shows an example of the dimensions of mattresses 10*a*, 10*b* and 10*c* in a mattress system according to FIG. 9, with kg/m3 as the measurement unit indicating the material hardness in different areas.

TABLE 3

| Mattress | Side | Softer end | Midpart | Harder end |
|---|---|---|---|---|
| 1 | XS | 20 | 40 | 30 |
| | S | 30 | 50 | 40 |
| 2 | M | 40 | 60 | 50 |
| | L | 50 | 70 | 60 |

TABLE 3-continued

| Mattress | Side | Softer end | Midpart | Harder end |
|---|---|---|---|---|
| 3 | XL | 60 | 80 | 70 |
| | XXL | 70 | 90 | 80 |

FIG. 10 shows a schematic view of a fourth mattress system according to the invention where the distribution of the hardness of the mattress areas or zones 21 to 26 substantially corresponds with those shown in FIGS. 1 to 7. A significant difference in the embodiment of FIG. 10 is that both sides of all the mattresses 10*a*, 10*b* and 10*c* consist of different areas rather than surface layers of different hardnesses, as in FIGS. 1 to 7.

Table 4 shows an example of the dimensions of mattresses 10*a*, 10*b* and 10*c* in a mattress system according to FIG. 10, with kg/m3 as the measurement unit.

TABLE 4

| Mattress | Side | End | Softer end | Inter-mediate | Midpart | Harder end | End |
|---|---|---|---|---|---|---|---|
| 1 | XS | 40 | 20 | 30 | 40 | 30 | 40 |
| | S | 50 | 30 | 40 | 50 | 40 | 50 |
| 2 | M | 60 | 40 | 50 | 60 | 50 | 60 |
| | L | 70 | 50 | 60 | 70 | 60 | 70 |
| 3 | XL | 80 | 60 | 70 | 80 | 70 | 80 |
| | XXL | 90 | 70 | 80 | 90 | 80 | 90 |

Figure 11:
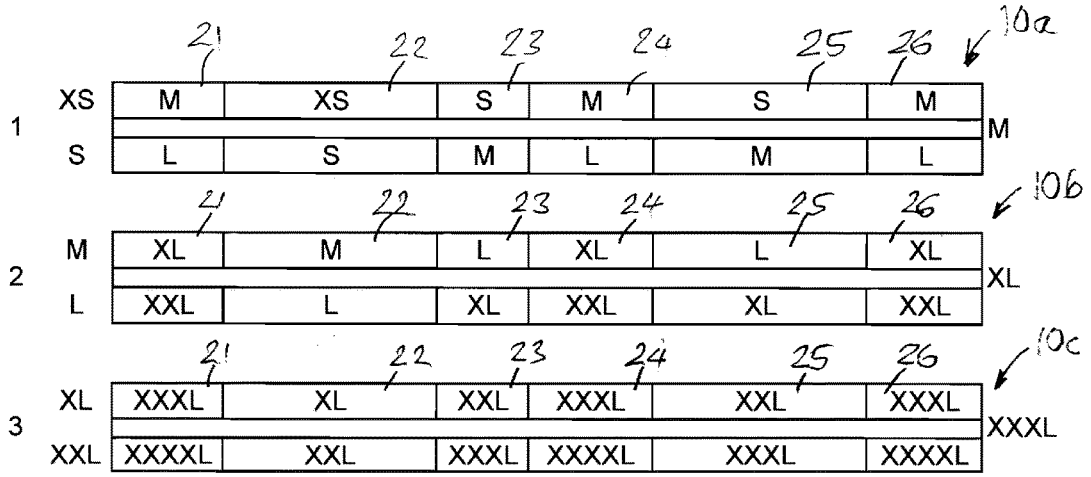

The mattress system shown in FIG. 11 corresponds with the system in FIG. 10 in other respects except that there is an intermediate layer 34 between the surface layers in the mattresses 10*a*, 10*b* and 10*c*. The intermediate layer 34 can merely consist of canvas or cloth, for example, but it can also be a thicker, relatively rigid or hard layer.

Table 5 shows an example of the dimensions of mattresses 10*a*, 10*b* and 10*c* in a mattress system according to FIG. 11, the material being plastic foam and with kg/m3 as the measurement unit.

TABLE 5

| Mattress | Side | End | Softer end | Inter-mediate | Midpart | Harder end | End |
|---|---|---|---|---|---|---|---|
| 1 | XS | 40 | 20 | 30 | 40 | 30 | 40 |
| | Inter-mediate layer | 40 | 40 | 40 | 40 | 40 | 40 |
| | S | 50 | 30 | 40 | 50 | 40 | 50 |
| 2 | M | 60 | 40 | 50 | 60 | 50 | 60 |
| | Inter-mediate layer | 60 | 60 | 60 | 60 | 60 | 60 |
| | L | 70 | 50 | 60 | 70 | 60 | 70 |
| 3 | XL | 80 | 60 | 70 | 80 | 70 | 80 |
| | Inter-mediate layer | 80 | 80 | 80 | 80 | 80 | 80 |
| | XXL | 90 | 70 | 80 | 90 | 80 | 90 |

It should be noted that the exemplary unit weights of various plastic foams shown in Tables 2 to 5 are simply intended for clarity's sake. In practice, the characteristics and dimensions of such plastic foam grades can significantly differ from what is presented here.

Figure 12:
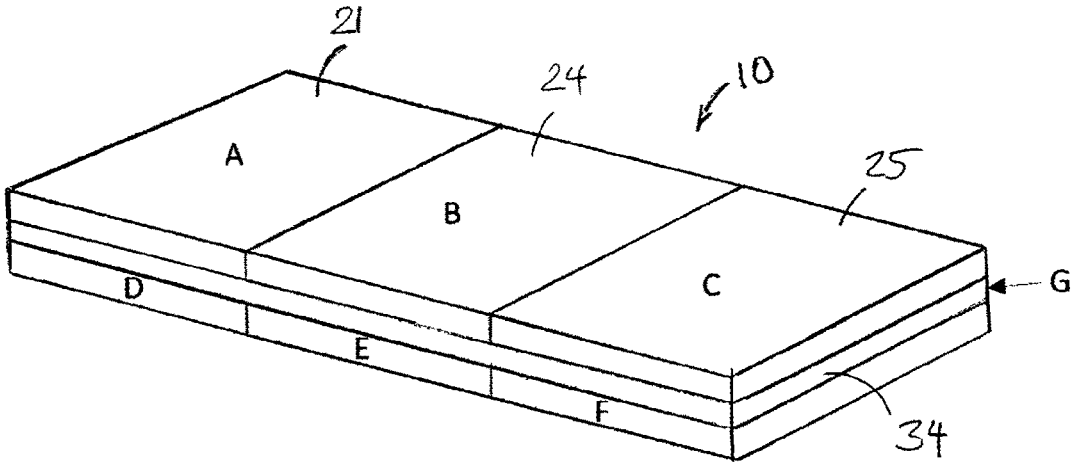

FIG. 12 shows a perspective view of yet another example of a mattress 10 according to the invention, the structure of which is also described below in Example 5. The plastic foam mattress 10 consists of seven cushion parts A to G glued with each other to form a single mattress, i.e. a solid bonded foam mattress. The structure has an intermediate layer G or a core sheet in the middle with three cushion parts A to C and D to E on either side of it. The various surface cushion parts of the bonded foam mattress form a zone system where the cushions differ from each other in hardness and load bearing capacity. In FIG. 12, zones A to C are indicated by reference numbers 21, 24 and 25, which thus correspond with the zones or areas described in previous figures.

Figure 13A:
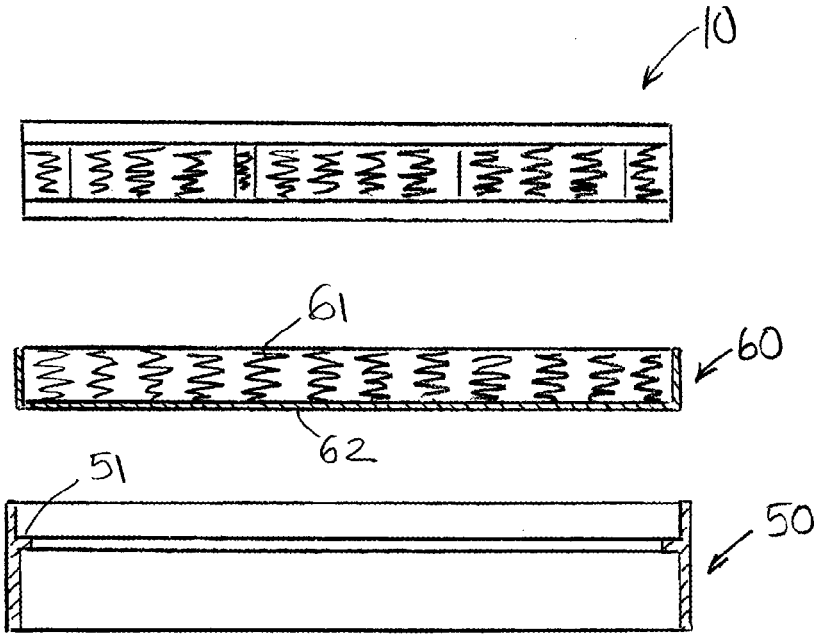
Figure 13B:
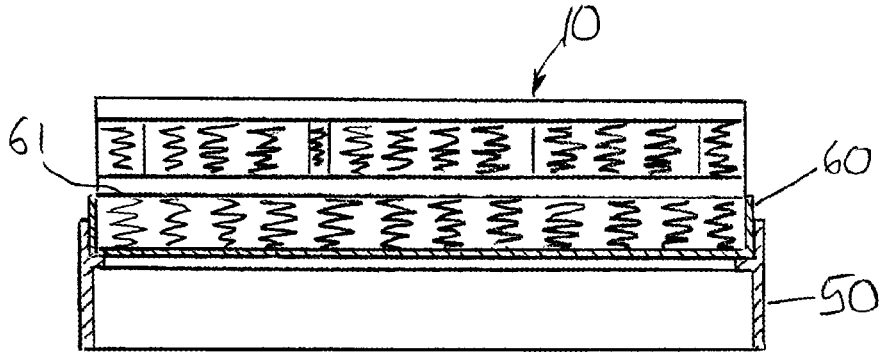

FIGS. 13A and 13B show a mattress 10 according to the invention and a bottom mattress 60 to be joined therewith. The bottom mattress 60 is placed in a bed frame 50, on side runners 51 therein, such that the springs 61 in the bottom mattress 60 are positioned upwards, against the mattress 10. Thus the combination jointly formed by the mattresses 10 and 60 is soft.

Figure 14A:
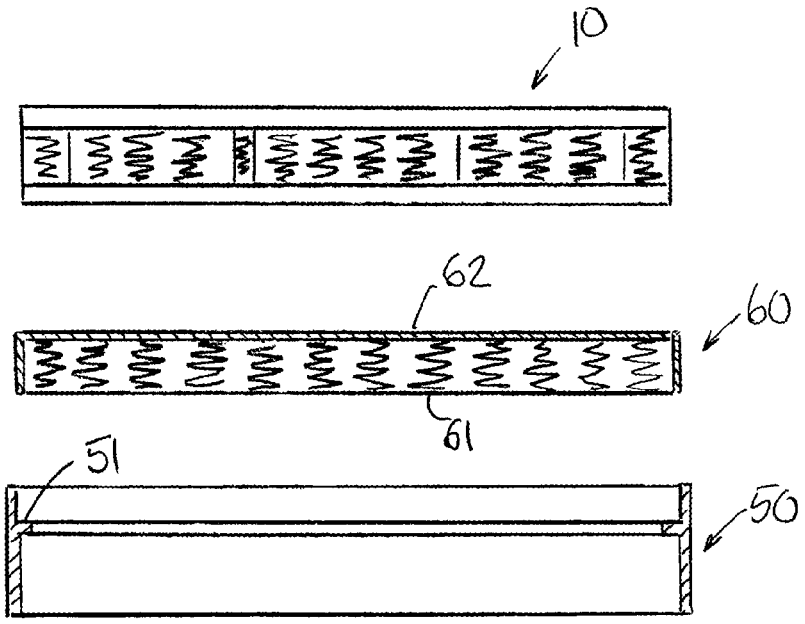
Figure 14B:
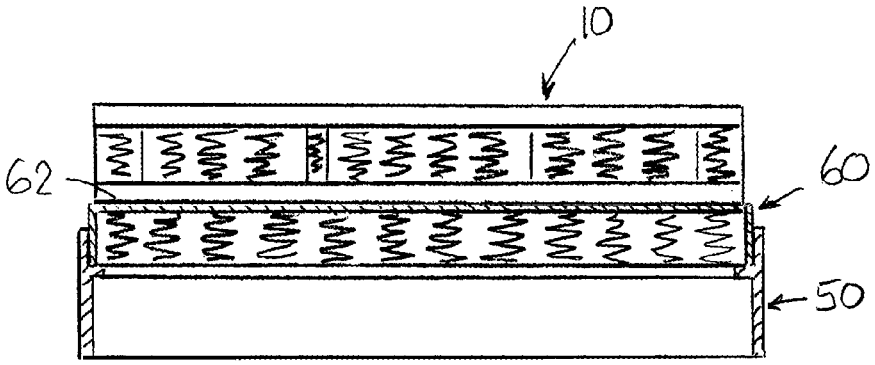

In FIGS. 14A and 14B, the bottom mattress 60 is turned over such that its hard bottom board 62 is positioned upwards, against the mattress 10. Thus the combination jointly formed by the mattresses 10 and 60 is hard because the springs 61 in the bottom mattress 60 are not in use.

EXAMPLE 1

The mattress system comprises three different mattresses with differing hardnesses. The mattresses are selected by means of the letters XS-S-M-L-XL-XXL describing the size of a person. The structure of the mattresses is as follows:

Mattress 1:

Coil springs of 1.8-mm-thick wire

1st side (XS), 25-mm-thick surface layer of 25-kg/m3 plastic foam

2nd side (S), 30-mm-thick surface layer of 35-kg/m3 plastic foam

Mattress 2:

Coil springs of 1.9-mm-thick wire

1st side (M), 25-mm-thick surface layer of 25-kg/m3 plastic foam

2nd side (L), 30-mm-thick surface layer of 35-kg/m3 plastic foam

Mattress 3:

Coil springs of 2.0-mm-thick wire

1st side (XL), 25-mm-thick surface layer of 25-kg/m3 plastic foam

2nd side (XXL), 30-mm-thick surface layer of 35-kg/m3 plastic foam

The required size categories are created by turning the mattresses over. The hardnesses of the different zones in the mattresses are created by means of heat treatment and pre-tensioning as follows. The zone numbers refer to the zones in FIGS. 1 to 7.

Zone 21: hard, 2 rows of springs, springs pre-tensioned to the H-high hardness Zone 22: soft, 9 rows of springs, springs pre-tensioned to S-low Zone 23: medium, 1 row of springs, springs pre-tensioned to M-medium Zone 24: hard, 6 rows of springs, springs pre-tensioned to the H-high hardness Zone 25: medium, 9 row of springs, springs pre-tensioned to M-medium Zone 26: hard, 2 rows of springs, springs pre-tensioned to the H-high hardness In addition to the wire gauge, the hardness of a mattress can also be affected by changing the characteristics of the cushioning in the mattress surface. Natural rubber can, for example, be used instead of plastic foam, particularly in the softer side of the mattress.

EXAMPLE 2

The areas in the soft side of the plastic foam mattress are made of plastic foam with a density of 25 to 38 kg/m3 and the areas in the hard side are made of plastic foam with a density of 30 to 45 kg/m3.

EXAMPLE 3

The mattress of the previous Example 2 is arranged more rigid such that an intermediate layer that is stiffer than the surface layers is placed in between said surface layers. This can be, for example, a rigid fabric or a third plastic foam layer with a density of 55 kg/m3. In both previous examples all plastic foam areas of different hardnesses are glued to each other or otherwise joined with each other, for example by placing them in the same fabric bag, whereby the mattress forms a continuous unit for multiple uses. The sections of the mattress with different hardnesses are not intended to be modified or replaced with other parts afterwards, even if this is possible. The various usability characteristics of the mattress are created by changing the positions of the mattress. Thus a single mattress is suitable for several persons of different sizes or also suitable for the same person if the shape, size or weight of his/her body changes.

EXAMPLE 4

The areas of different hardnesses in the plastic foam mattress can also be created by arranging lateral or longitudinal grooves along the mattress plane at desired locations on a plastic foam layer of standard hardness. The grooves can also be perpendicular to the mattress plane. The more grooves there are inside the plastic foam layer, the softer the plastic foam layer is at the grooves.

EXAMPLE 5

A plastic foam mattress consists of seven cushion parts glued with each other to form a single mattress, i.e. solid bonded foam mattress. The structure has an intermediate layer or a core sheet in the middle, with three cushion parts on either side of it. The various surface cushion parts of the bonded foam mattress form a zone system where the cushions differ from each other in hardness and load bearing capacity. The differences in load bearing capacity form a unity wherein one side of the bonded foam mattress has a larger overall bearing capacity than the opposite side. Also the different zones on the same side of the mattress differ from each other, whereby a softer shoulder zone with a larger load bearing capacity can be arranged. The mattress system includes bonded foam mattresses of different sizes and with different characteristics. Most advantageously, the mattress system has substantially three different overall stiffnesses, wherein the sizes XS/S, M/L and XL/XXL are marked on the opposite sides of the mattress, and all the sizes also have shoulder zones with different stiffnesses.

Additional Notes

It is obvious to a person skilled in the art that the different embodiments of the invention may vary within the scope of the claims presented below. The elasticity of a mattress according to the invention can be created by any known elastic material, such as compressible coil springs, rubber cords, plastic foams of different hardnesses, elastic wood slat solutions or gel. While using any of the different elastic materials, the different areas in the mattress are always arranged, however, such that the spine of a person using the mattress stays as straight as possible while sleeping. As people's bodies vary, a mattress with uniform elasticity throughout the mattress area cannot support the body correctly. The support required by a broad-shouldered person for example differs from that required by a person with a larger midriff. The body of a sleeping person accordingly requires correct support.

A mattress according to the invention is arranged for multiple use such that the mattress has areas with different elasticities. Thus the user of the mattress can, according to his/her body structure, choose whether to use the mattress that provides more support either to the shoulder region or the hips region. A softer or harder side of the mattress can additionally be selected for use by turning the mattress over. It is most advantageous to the mattress area supporting the sleeper's shoulders for one's primary use. If the person is broad-shouldered, the mattress must be softer at the shoulders in relation to the hips. If the person's hips are larger, it is advantageous to select the softer area of the mattress for the hip area.

On a mattress according to the invention, one can choose whether the softer area of the mattress supports the shoulders or the hips. If the conditions later on change, one can sleep on the mattress such that the areas to be used are switched the other way around. Furthermore according to the invention, one side of the mattress is made harder whereby one can later make use of the more rigid side if the conditions change and if the first side of the mattress feels too limp after the person has gained weight, for example. On the stiffer side, one can again choose, according to the current conditions and body shape, whether to have the softer area of the mattress support the shoulders or the hips.

A mattress according to the invention lends itself for multiple uses because it has several areas with different characteristics. Therefore a single person can use the same mattress in many different ways, as though they has several different mattresses at the same time. The mattress furthermore lends itself for multiple uses because, due to its several different areas, the same mattress is applicable for several different persons, who otherwise would need different mattresses.

Due to the multiple uses of the mattress, the person also does not have to acquire a new mattress in the case of temporary or permanent changes to the shape, size or weight of his/her body. Such circumstances of change include, for example, gaining or losing weight or pregnancy. It can therefore be said that a mattress according to the invention readily reacts to bodily changes, in other words it fits the user permanently. Changes can be carried out as easily as one changes their clothing size. A mattress according to the invention therefore has markings corresponding with those familiar from the clothing industry.

When using a mattress according to the invention, one can also easily change the ends if a broad-shouldered person needs a more elastic area for his/her shoulders. Similarly a pear-shaped person or someone with wide hips can change the mattress ends such that the hips rest on a more elastic section of the mattress. The simplicity of use of the mattress is highlighted by the fact that a mattress according to the invention is a continuous unit, and thus no separate adjustment pieces or replacement pieces are needed for modifying its characteristics.

A mattress according to the invention is particularly advantageous if its user generally sleeps on his/her side. The elasticity of the section for the person's shoulders is a significant characteristic, which makes sure that the person's spine remains sufficiently straight while sleeping. However, a mattress according to the invention is equally advantageous even if the person sleeps on his/her back or in another position.

LIST OF REFERENCE NUMBERS

10 Mattress
10*a* Mattress
10*b* Mattress
10*c* Mattress
21 Zone
22 Zone
23 Zone
24 Zone
25 Zone
26 Zone
30 End
31 Surface layer
32 Surface layer
33 Marking
34 Intermediate layer
40 Person
41 Hips
42 Shoulders
43 Head
44 Legs
45 Spine
50 Bed
51 Support edge
60 Bottom mattress
61 Springs
62 Hard bottom

The invention claimed is:

1. A mattress having a first surface and an opposed second surface and having at least three zones of different hardnesses for different parts of a body of a user of the mattress, comprising three zones of different hardnesses comprising vertical coil springs and located in the mattress such that a first zone is located between the midpoint of the mattress and one end, a second zone is located between the midpoint of the mattress and an other end, and a third zone is located between the first zone and the second zone, the three zones are of different hardnesses such that the first zone is softer than the second zone, and the third zone is harder than both the first zone and the second zone, a first surface layer on said first surface and a second surface layer on said opposed second surface, said first and second surface layers having different hardnesses such that corresponding asymmetric zones of different hardnesses are formed in said first surface and said opposed second surface of the mattress, and the zones of different hardnesses in one surface of the mattress are softer than the corresponding zones of different hardnesses in the opposed surface of the mattress.

2. The mattress as claimed in claim 1, wherein in said first surface and said opposed second surface of the mattress the hardnesses of the zones are arranged in such order that the first zone of said first surface of the mattress is the softest zone, next is the second zone of said first surface, then the first zone of said opposed second surface, and the second zone of said opposed second surface is the hardest.

3. The mattress as claimed in claim 1, wherein the hardnesses of the both surfaces of the mattress correspond with size markings XS, S, M, L, XL and XXL used in the clothing industry, such that the hardness corresponds to the size of clothing of the person using the mattress.

4. The mattress as claimed in claim 1, wherein an end of the mattress where the first zone of the mattress is located is marked (−) and an end of the mattress where the second zone of the mattress is located is marked (+).

* * * * *